United States Patent [19]

Yoshida et al.

[11] Patent Number: 4,565,221

[45] Date of Patent: Jan. 21, 1986

[54] CONTROL VALVE ASSEMBLY

[75] Inventors: Kunihiko Yoshida; Eiki Izumi, both of Ibaraki; Shuichi Ichiyama, Tsuchiura, all of Japan

[73] Assignee: Hitachi, Ltd., Tokyo, Japan

[21] Appl. No.: 582,575

[22] PCT Filed: May 31, 1983

[86] PCT No.: PCT/JP83/00173

§ 371 Date: Feb. 2, 1984

§ 102(e) Date: Feb. 2, 1984

[87] PCT Pub. No.: WO83/04289

PCT Pub. Date: Dec. 8, 1983

[30] Foreign Application Priority Data

Jun. 2, 1982 [JP] Japan ..... 57-93022

[51] Int. Cl.[4] ..... F15B 13/06; F15B 13/09

[52] U.S. Cl. ..... 137/885; 60/484; 60/486

[58] Field of Search ..... 60/459, 466, 484, 486; 137/596.14, 596.15, 596.16, 596.18, 885

[56] References Cited

U.S. PATENT DOCUMENTS

| | | | |
|---|---|---|---|
| 3,411,536 | 11/1968 | Tennis | 60/466 X |
| 3,793,831 | 2/1974 | Khatti | 60/484 X |
| 4,149,565 | 4/1979 | Jennings et al. | 60/484 X |

*Primary Examiner*—Gerald A. Michalsky

*Attorney, Agent, or Firm*—Antonelli, Terry & Wands

[57] ABSTRACT

A control valve assembly having a plurality of control valves, each including a pair of logic valves, with each of the logic valves having a pump port, a work port and a pilot port. The control valve assembly has a housing, and a pair of hydraulic fluid passageways arranged in the housing in side-by-side relationship. Each pair of logic valves, constituting one of the control valves, are arranged in the housing in such a manner that they are located in opposed relationship to each other in a direction substantially perpendicular to a direction in which the hydraulic fluid passageways extend. The pump ports of the logic valves are in communication with the associated hydraulic fluid passageways. The work ports of the logic valves are oriented in a direction substantially perpendicular to both the direction in which the hydraulic fluid passgeways extend and the direction in which the pair of logic valves are arranged.

9 Claims, 4 Drawing Figures

CONTROL VALVE ASSEMBLY

BACKGROUND OF THE INVENTION

This invention relates to a control valve assembly having a plurality of control valves each including a pair of logic valves, and, more particularly to a control valve assembly for controlling a supply of hydraulic fluid to a hydraulic actuator in a hydraulic construction machine such as a hydraulic excavator.

In hydraulic construction machines such as hydraulic excavators, it has been the usual practice to use spool type directional control valves for controlling a supply of hydraulic fluid to an actuator. However, this type of directional control valves suffers the disadvantage that, since a gap for sliding portions is necessary between a spool valve body and a valve casing, internal leaks of the fluid through the gap occur when the actuator is a cylinder, thereby making it impossible to avoid an inadvertent displacement of the piston rod in the cylinder.

In view of the above disadvantage of spool type directional control valves, it has been proposed in, for example, Japanese Laid-Open Pat. No. 14670/81, to use a pair of poppet type logic valves as a control valve of the control valve assembly, with the advantage of the poppet type logic valve being that internal leaks of the fluid can be eliminated.

An object of this invention is to avoid the problems encountered in the prior art and to provide a control valve assembly comprising logic valves which enable fabrication and maintenance of a hydraulic fluid circuit to be readily effected.

Another object of the present invention is to provide a control valve assembly comprising logic valves which enables fabriction of a hydraulic fluid circuit for supplying hydraulic fluid to one actuator from a plurality of pumps in a combined flow to be readily effected.

According to the invention, a control valve assembly is provided having a plurality of control valves each including a pair of logic valves, with each of the logic valves having a pump port, a work port and a pilot port. The control valve assembly comprises a housing, and a pair of hydraulic fluid passageways arranged in side-by-side relationship in the housing. Each pair of logic valves, constituting one of the control valves, are arranged in the housing in such a manner that they are located in opposed relationship to each other in a direction substantially perpendicular to the direction in which the hydraulic fluid passageways extend. The pump ports of the pair of logic valves are in communication with the associated hydraulic fluid passageways, and the work ports of the pair of logic valves are oriented in a direction substantially perpendicular to both the direction in which said hydraulic fluid passageways extend and the direction in which said pair of logic valves are arranged.

Preferably, the pilot ports of each pair of logic valves which constitutes one of the control valves are oriented in the direction of which the pair of logic valves are arranged in such a manner that they are located at opposite ends of the logic valves from the pump ports thereof.

The control valve assembly preferably further comprises a second pair of hydraulic fluid passageways arranged in side-by-side relationship in the housing, and a second plurality of control valves each including a pair of logic valves. The second plurality of control valves are associated with the second pair of hydraulic fluid passageways in the same manner as the first mentioned plurality of control valves are associated with the first pair of hydraulic fluid passageways. The second pair of hydraulic fluid passageways are longitudinally aligned with the first mentioned pair of hydraulic fluid passageways, and the second plurality of control valves are arranged in a single row with the first mentioned plurality of control valves.

It is also possible in accordance with the present invention to provide a control valve assembly which further comprises a third pair of hydraulic fluid passageways located below the first mentioned pair of hydraulic fluid passageways, a fourth pair of hydraulic fluid passageways located below the second pair of hydraulic fluid passageways and longitudinally aligned with the third pair of hydraulic fluid passageways, and a third plurality and a fourth plurality of control valves connected to the third pair and fourth pair of hydraulic fluid passageways respectively and each control valve including a pair of logic valves. The third plurality and fourth plurality of control valves are arranged in a single row with each other whereby the row of the first plurality and second plurality of control valves and the row of the third plurality and fourth plurality of control valves provide a plurality of stages of rows of control valves. Each pair of logic valves constituting one of the third plurality and fourth plurality of control valves, have work ports which are in communication with the work ports of each pair of logic valves constituting upper ones of the first mentioned plurality of control valves and the second plurality of control valves.

The housing may comprise a single block or a plurality of block sections.

DETAILED DESCRIPTION

Figure 1:
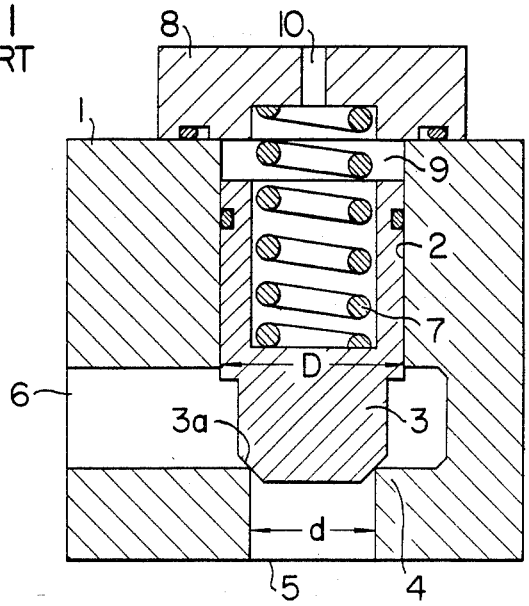
FIG. 1 PRIOR ART
FIG. 1 is a sectional view of a logic valve of the prior art.

Referring now to the drawings wherein like reference numerals are used throughout the various views to designate like parts and, more particularly, to FIG. 1, according to this figure, a poppet type logic valve of the type disclosed in the aforementioned Japanese Laid Open Pat. No. 14670/81 includes a valve housing 1 defining therein a valve chamber 2 having a poppet valve body 3 slidably fitted therein. The poppet valve body 3 is formed at its forward end with a tapering portion 3*a* adapted to be brought into contact with a valve seat 4 formed in the valve housing 1 to bring a first port 5 out of communication with a second port 6 and brought out of contact therewith to bring the first and second ports 5, 6 into communication with each other. The poppet valve body 3 is urged by a spring 7 in a direction of the valve seat 4. A pilot chamber 9 is defined between an upper end of the poppet valve body 3 and a cover 8 for the housing 1, with the pilot chamber 9 receiving a pilot pressure signal applied thereto through a pilot port 10.

When the pilot port pressure signal is at a reservoir pressure level, that is, zero or substantially zero, a flow of fluid from the first port 5 to the second port 6 acts on the pressure receiving area of the poppet valve body 3 which corresponds to a diameter d of the valve seat 4 to move the same upwardly and bring the port 5, 6 into communication with each other. A flow of fluid from the second port 6 to the first port 5 acts on the annular pressure receiving area of the poppet valve body 3 corresponding to the difference between the diameter D of the poppet valve body 3 in the diameter d of the valve seat 4 to move the same upwardly and bring the ports 6, 5 into communication with each other.

When the pilot pressure signal rises to a higher pressure level, or the pilot port 10 is blocked, upward movement of the poppet valve body 3 is prevented so that the ports 5, 6 are brought out of communication with each other.

Figure 2:
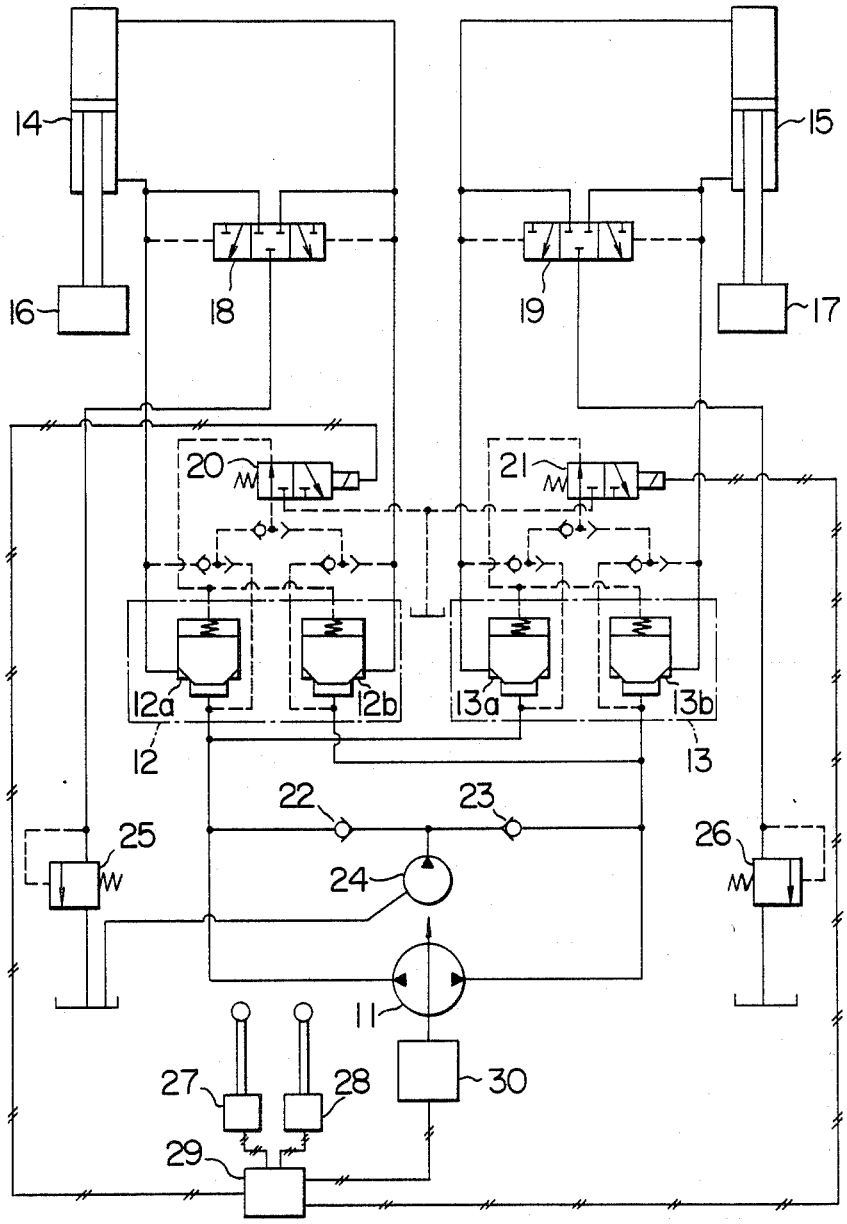
FIG. 2 PRIOR ART
FIG. 2 is a circuit diagram of a hydraulic fluid circuit using control valves of the prior art each including a pair of logic valves.

As shown in FIG. 2, a hydraulic fluid circuit in which pairs of logic valves of the type described hereinabove are employed to form control valves to feed a supply of pressurized fluid to a plurality of actuators by using a pump capable of varying its discharge direction, with the hydraulic fluid circuit including a variable displacement type hydraulic pump 11 capable of tilting a swash plate thereof in either direction, and with the pump 11 being connected, in a closed circuit, to cylinders 14, 15 having loads 16, 17, respectively, through control valves 12, 13 including a pair of logic valves 12*a*, 12*b* and a pair of logic valves 13*a*, 13*b*, respectively. The hydraulic circuit further includes flushing valves 18, 19, relief valves 25, 26, operation levers 27, 28, a charge pump 24, a control circuit 29, and a tilting angle control device 30 for controlling the tilting angle of a swash plate of the variable displacement type hydraulic pump 11.

When the variable displacement type hydraulic pump is in a neutral position, in which the operation levers 27, 28 remain inoperative, the tilting angle of the swash plate of the hydraulic pump 11 is maintained at zero, and the solenoid-operated on-off valves 20, 21 are each held in a returned position such as illustrated in FIG. 2. Consequently, holding pressures of the cylinders 14, 15 are applied as pilot pressure signals to the pairs of logic valves 12*a*, 12*b* and 13*a*, 13*b*, respectively, to maintain the logic valves in the closed positions.

If the operation lever 27 is moved in a direction in which a rod of the cylinder 14 is moved upwardly therefrom, then a current is passed to the solenoid-operated on-off valve 20 to reduce the pilot pressure signals applied to the logic valves 12*a*, 12*b* to a reservoir pressure level. Meanwhile, the variable displacement type hydraulic pump 11 discharges and supplies pressurized fluid to the logic valve 12*b* as the tilting angle control device 30 is actuated when the operation lever 27 is moved. The logic valve 12*b* is brought to an open position and the pressurized fluid is fed to a lower side chamber of the cylinder 14. Fluid flowing out of the rod-side chamber of the cylinder 14 opens the logic valve 12*a* before returning to the suction side of the variable displacement type hydraulic pump 11.

In the hydraulic fluid circuit described hereinabove in connection with FIGS. 1 and 2, the logic valves 12*a*, 12*b*, 13*a*, 13*b* are independent entities of a cylindrical shape so that a piping system of a substantial length is necessary to connect the logic valves together thereby rendering fabrication and maintenance a relatively time consuming operation. When hydraulic fluid is supplied to one actuator from a plurality of pumps in a combined flow, the number of logic valves further increases and, consequently, difficulties are encountered in forming a hydraulic fluid circuit.

Figure 3:
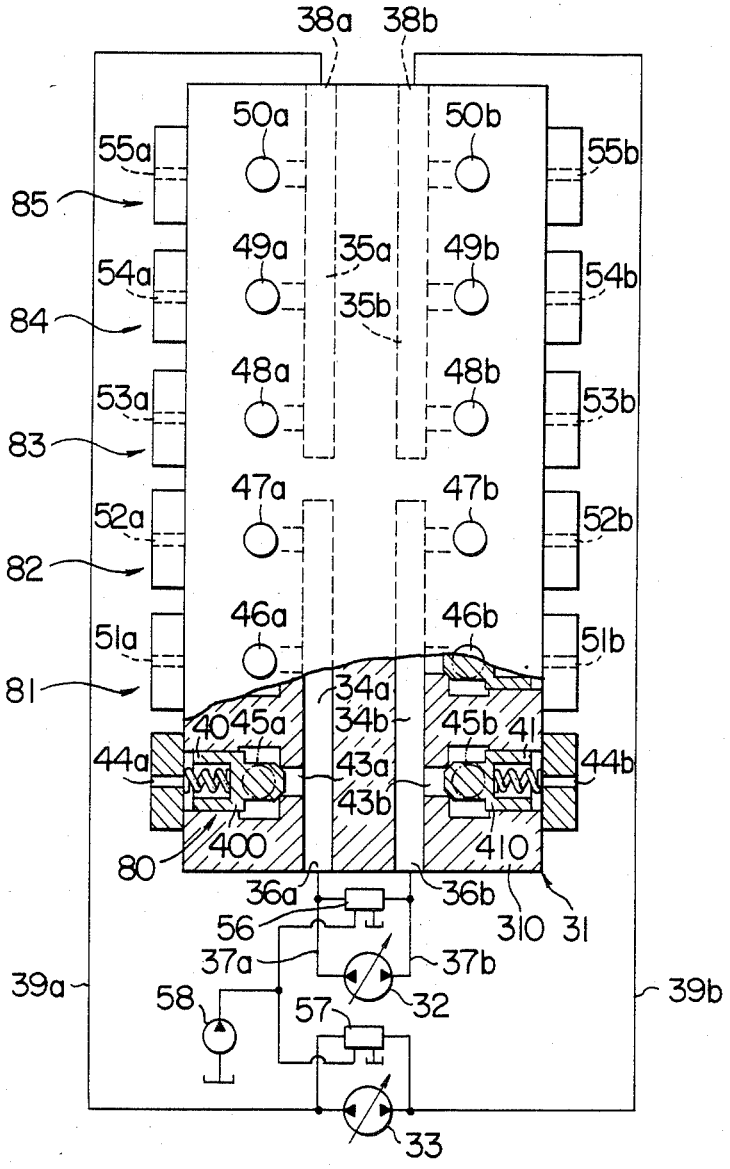
FIG. 3 is a partial cross-sectional plan view of one embodiment of the control valve assembly in accordance with the invention, showing a circuit for connection to pumps.

In accordance with the present invention, as shown in FIG. 3, a control valve assembly generally designated by the reference numeral 31 is connected to two variable displacement type hydraulic pumps 32, 33, with the control valve assembly 31 including a housing 310 in which a pair of hydraulic fluid passageways 34*a*, 34*b* and a pair of hydraulic fluid passageways 35*a*, and 35*b* longitudinally aligned with the pair of hydraulic fluid passageways 34*a*, 34*b* are arranged in side-by-side relationship. The hydraulic fluid passageways 34*a*, 34*b* have common pump ports 36*a*, 36*b* connected to two ports of the variable displacement type hydraulic pump 32 through conduits 37*a*, 37*b*, respectively, and the hydraulic fluid passageways 35*a*, 35*b* have common pump ports 38*a*, 38*b* connected to two ports of the variable displacement type hydraulic pumps 33 through conduits 39*a*, and 39*b*, respectively. Three control valves, each constituted by a pair of logic valves, are provided for each of the variable displacement type hydraulic pumps 32, and 33, so that a total of six control valves are provided. FIG. 3 shows only one of such control valves or a control valve generally designated by the reference numeral 80 including a pair of logic valves 40, 41 in a complete form.

The pair of logic valves 40, 41, constituting the control valve 80, are arranged in the housing 310 in such a manner that pump ports 43*a*, 43*b* face toward each other, pilot ports 44*a*, 44*b* face outwardly in opposite directions, and valve bodies 400, 410 face each other in a direction substantially perpendicular to a direction in which the hydraulic fluid passageways 34*a*, 34*b* extend. The pump ports 43*a*, 43*b* of the logic valves 40, 41 communicate with the hydraulic fluid passageways 34*a*, 34*b*, respectively, and work ports 45*a*, 45*b*, of the logic valves 40, 41, connected to actuators, are arranged in a direction substantially perpendicular to both the direction in which the hydraulic fluid passageways 34*a*, 34*b* extend and the direction in which the logic valves 40, 41 are arranged.

Each pair of logic valves constituting one of the control valves generally designated by the reference numerals 81–85 is of the same construction as described by referring to the pair of logic valves 40, 41. The control valves 80 to 85 are arranged in a single row, and work ports 46*a*, 46*b* to 50*a*, 50*b* of the control valves 81 to 85 are located in the same face of the housing 310 as the work ports 45*a*, 45*b* while pilot ports 51*a* to 55*a* and 51*b* to 55*b* of the control valves 81 to 85 are located in the same faces of the housing 310 as the pilot ports 44*a* and 44*b*, respectively. A flushing valve 57, and a charge pump 58 are also provided.

The logic valve 40 is communicated with the logic valves having the work ports 46*a*, 47*a* through the hydraulic fluid passageway 34*a*, and the logic valve 41 is communicated with the logic valves having the work ports 46*b*, 47*b* through the hydraulic fluid passageway 34*b*, so that conduits between them can be eliminated. The same applies to the logic valves associated with the hydraulic fluid passageways 35*a*, 35*b*. The direction in which the hydraulic fluid passageways 34*a*, 34*b*, 35*a* and 35*b* are oriented, the direction in which the logic ports 40 and 41 are oriented, and the direction in which the work ports 45*a*, 45*b* to 50*a*, 50*b* are oriented are substantially perpendicular to one another. This clearly defines the positions of the work ports and pilot ports, facilitates fabrication of the control valve assembly 31 and assembling of the hydraulic fluid circuit and facilitates their maintenance. Also by connecting to one actuator not only the work ports 45*a*, 45*b* of the control valve 80 and the work ports 50*a*, 50*b* of the control valve 85, for example, it is possible to feed to a particular actuator a supply of hydraulic fluid in a combined flow from the two pumps 32, 33.

Figure 4:
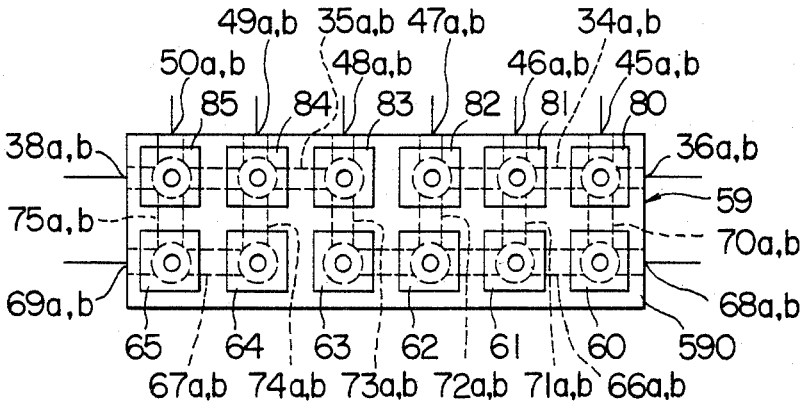
FIG. 4 is a side view of another embodiment of the control valve assembly in accordance with the invention.

FIG. 4 provides an example of a control valve assembly generally designated by the reference numeral 59 of a matrix construction in which a plurality of control valves, each including a pair of logic valves, are arranged in two stages in a row and hydraulic fluid passageways are arranged in the form of a latticework. In FIG. 4, four variable displacement type hydraulic pumps are used for feeding a supply of hydraulic fluid to one actuator in a combined flow from two or more variable displacement type hydraulic pumps.

As shown in FIG. 4, the control valves 80 to 85 form an upper row of the control valve assembly 59, with additional control valves 60 to 65, each including a pair of logic valves, being arranged in a housing 590 to form a lower row, and pump ports of the logic valves of the control valves 60 to 63 being communicated with hydraulic fluid passageways 66*a* and 66*b*, while pump ports of the logic valves of the control valves 64, 65 are communicated with hydraulic fluid passageways 67*a*, 67*b*. The hydraulic fluid passageways 66*a*, 66*b* have common pump ports 68*a*, 68*b* at their open ends which are connected to two ports of a third variable displacement type hydraulic pump, not shown, and hydraulic fluid passageways 67*a*, 67*b* have common pump ports, 69*a*, 69*b* which are connected to two ports of a fourth variable displacement type hydraulic pump, not shown. Communication is maintained between work ports of the control valves in different rows through hydraulic fluid passageways 70*a* and 70*b* to 75*a* and 75*b*.

In embodiment of FIG. 4, hydraulic fluid can be fed to one actuator from two variable displacement type hydraulic pumps in a combined flow by simultaneously bringing two control valves of the upper and lower rows to open positions. Also by connecting the work ports of two control valves or the work ports 45*a*, 45*b* and 50*a*, 50*b* of the control valves 80 and 85, for example, to one actuator, it is possible to feed to the particular actuator hydraulic fluid from four variable displacement type hydraulic pumps in a combined flow. And by connecting the work ports 45*a*, 45*b* and 48*a*, 48*b* of the control valves 80, 83 together to one actuator, it is possible to feed to the particular actuator hydraulic fluid from three variable displacement type hydraulic pumps in a combined flow. Moreover, even when work ports of one control valve or the work ports 45*a*, 45*b* of the control valve 80, for example, are connected to one actuator, it is possible to feed to the particular actuator hydraulic fluid from four hydraulic pumps in a combined flow formed in the assembly 59 by closing the work ports 48*a*, 48*b* and 50*a*, 50*b* of the control valves 83 and 85 and opening the control valves 60, 63, 65, 80, 83 and 85.

In the embodiments shown in FIGS. 3 and 4, a plurality of control valves are arranged in the housing 310, 590 in the form of a single block. However, the invention is not limited to this specific arrangement of the single block type and the invention can have application in a sectional type in which each pair of logic valves are housed in one housing constituting a block section and a plurality of block sections are successively connected together to constitute a control valve assembly. The variable displacement type hydraulic pumps 32, 33 may be replaced by fixed displacement type hydraulic pumps in which only the discharge direction is variable.

From the foregoing description, it will be appreciated that according to the invention, a pair of hydraulic fluid passageways are arranged in a housing in side-by-side relationship and a plurality of pairs of logic valves each pair constituting a control valve are arranged in the housing in such a manner that the logic valves forming a pair are located in opposed relation to each other in a direction substantially perpendicular to a direction in which the hydraulic fluid passageways extent. The pump ports of each pair of logic valves are communicated with the associated hydraulic fluid passageways, and the work ports of each pair of logic valves are oriented in a direction substantially perpendicular to both the direction in which the hydraulic fluid passageways extend and the direction in which the pair of logic valves are arranged. Thus, the need to lay conduits between the logic valves is eliminated and the positions of the work ports are clearly defined, so that fabrication and maintenance of the hydraulic fluid circuit are facilitated. It will be also appreciated that according to the invention, a second pair of hydraulic fluid passageways are longitudinally aligned with the first mentioned pair of hydraulic fluid passageways, and control valves are associated with the second pair of hydraulic fluid passageways, and moreover, a third pair and a fourth pair of hydraulic fluid passageways are provided below the first pair and the second pair of hydraulic fluid passageways respectively, and control valves are associated with these pairs of hydraulic fluid passageways to provide a plurality of stages of rows of control valves. Thus, control valves are readily arranged in a matrix construction in which the hydraulic fluid passageways are located in the form of a latticework, thereby enabling a hydraulic fluid circuit to be readily provided in which hydraulic fluid can be fed to one actuator from a plurality of pumps in a combined flow.

We claim:

1. A control valve assembly having a plurality of control valves each including a pair of logic valves, each of the logic valves having a pump port, a work port and a pilot port, said control valve assembly comprising:

a housing; and a pair of hydraulic fluid passageways arranged in said housing so as to extend in side-by-side relationship with each other, one of the passageways being in communication with the pump ports of a first plurality of logic valves each constituting one of said pair of logic valves for providing one of a common hydraulic fluid supply conduit and a discharge conduit to said first plurality of logic valves, and the other of the passageways being in communication with the pump ports of a second plurality of logic valves each constituting the other of said pair of logic valves for providing the other of said common hydraulic fluid supply conduit and discharge conduit to said second plurality of logic valves;

each of said pair of logic valves which constitutes one of said control valves being arranged in said housing in such a manner that they are located in an opposed relationship to each other in a direction substantially perpendicular to a direction in which said hydraulic fluid passageways extend; and the work ports of each of said pair of logic valves being oriented substantially in a direction substantially perpendicular to both the direction in which said hydraulic fluid passageways extend and the direction in which said pair of logic valves are arranged whereby all the work ports of said logic valves are opened in the same side of the housing.

2. A control valve assembly as claimed in claim 1, wherein the pilot ports of each pair of logic valves which constitute one of said control valves are oriented in the direction in which said pair of logic valves are oriented in such a manner that they are located at opposite ends of the logic valves from the pump ports thereof whereby all of the pilot ports of said first plurality of logic valves constituting one of each of said pair of logic valves open in the same side of said housing, and all of the pilot ports of said second plurality of logic valves each constituting one of each of said pair of logic valves open in the same side of the housing opposite to the side of the housing in which the pilot ports of the first plurality of logic valves open.

3. A control valve assembly as claimed in claim 1, further comprising a second pair of hydraulic fluid passageways arranged in side-by-side relation in said housing, and a second plurality of control valves each including a pair of logic valves, said second plurality of control valves being associated with said second pair of hydraulic fluid passageways in the same manner as the first mentioned plurality of control valves are associated with the first pair of hydraulic fluid passageways.

4. A control valve assembly as claimed in claim 3, wherein said second pair of hydraulic fluid passageways are longitudinally aligned with said first mentioned pair of hydraulic fluid passageways, and said second plurality of control valves are arranged in a single row with the first mentioned plurality of control valves.

5. A control valve assembly as claimed in claim 4, further comprising a third pair of hydraulic fluid passageways located below the first mentioned pair of hydraulic fluid passageways, a fourth pair of hydraulic fluid passageways located below the second pair of hydraulic fluid passageways and longitudinally aligned with the third pair of hydraulic fluid passageways, and a third plurality and a fourth plurality of control valves connected to the third pair and fourth pair of hydraulic fluid passageways respectively and each control valve including a pair of logic valves, said third plurality and fourth plurality of control valves being arranged in a single row with each other whereby the row of said first plurality and second plurality of control valves and the row of said third plurality and fourth plurality of control valves provide a plurality of stages of rows of control valves.

6. A control valve assembly as claimed in claim 5, wherein each said pair of logic valves which constitute one of said third plurality and fourth plurality of control valves have work ports which are in communication with the work ports of each pair of logic valves which constitute upper ones of the first mentioned plurality of control valves and the second plurality of control valves.

7. A control valve assembly as claimed in any one of claims 1–6, wherein said housing comprises a single block.

8. A control valve assembly having a plurality of pairs of logic valves, each having first and second ports serving as inlet and outlet ports for hydraulic fluid flow and a pilot port, said control valve assembly comprising:

a housing having first and second opposed end faces, first and second opposed side faces, third and fourth opposed side faces extending in a longitudinal direction of said housing and connecting said first and second opposed end faces;

first and second hydraulic fluid passageways formed in said housing so as to extend in a side-by-side relationship with respect to each other substantially in a longitudinally direction of said housing, said first and second hydraulic fluid passageways each being opened at one end thereof in one of said first and second opposed end faces to provide a common port for hydraulic fluid supply to and discharge from the control valve assembly and being closed at the other end thereof in said housing;

said plurality of pairs of logic valves being arranged in said housing such that each pair of logic valves are aligned in a direction transverse to said longitudinal direction and to said first and second passageways and are in an opposed relationship with respect to each other;

one of said first and second ports of a first plurality of logic valves each constituting one of each of said pair of logic valves being in communication with one of said first and second passageways, and one of said first and second ports of a second plurality of logic valves each constituting the other of each of said pair of logic valves being in communication with the other of said first and second passageways; and the other of said first and second ports of said first and second plurality of logic valves functioning as work ports and being opened in one of said first and second side faces of the housing whereby all of the workports can be located in the same side face of the housing.

9. A control valve assembly as claimed in claim 8, wherein all of the pilot ports of said first plurality of logic valves are opened in one of said third and fourth side faces, and all of the pilot ports of said second plurality of logic valves are opened in the other of said third and fourth side faces.

* * * * *

UNITED STATES PATENT AND TRADEMARK OFFICE

CERTIFICATE OF CORRECTION

PATENT NO. : 4,565,221

DATED : January 21, 1986

INVENTOR(S) : Yoshida, et al

It is certified that error appears in the above-identified patent and that said Letters Patent is hereby corrected as shown below:

On the title page assignee should read

-- (73) Assignee: Hitachi Construction Machinery Co., Ltd. --.

Signed and Sealed this

*Twelfth* Day of *August 1986*

[SEAL]

*Attest:*

DONALD J. QUIGG

*Attesting Officer*

*Commissioner of Patents and Trademarks*